US006381773B1

(12) United States Patent
McAllister

(10) Patent No.: US 6,381,773 B1
(45) Date of Patent: May 7, 2002

(54) BASE FOR BARRIER-FREE SHOWER ENCLOSURE

(75) Inventor: George P. McAllister, Franklin, TN (US)

(73) Assignee: AquaBath, Inc, Nashville, TN (US)

( * ) Notice: Subject to any disclaimer, the term of this patent is extended or adjusted under 35 U.S.C. 154(b) by 95 days.

(21) Appl. No.: 09/073,535

(22) Filed: May 6, 1998

(51) Int. Cl.[7] ..... A47K 3/40

(52) U.S. Cl. ..... 4/604; 4/613

(58) Field of Search ..... 4/604, 613

(56) References Cited

U.S. PATENT DOCUMENTS 2,449,323 A * 9/1948 Richterkessing ..... 4/613
5,243,716 A * 9/1993 Zaccai et al. ..... 4/604
5,718,008 A * 2/1998 Pane ..... 4/613

* cited by examiner

*Primary Examiner*—Robert M. Fetsuga
(74) *Attorney, Agent, or Firm*—B. Craig Killough

(57) ABSTRACT

A base for a barrier-free shower enclosure having the combined configuration of a drain sump and drain. A series of channels is formed into the base of the shower enclosure which trap water within the shower enclosure and channel the water toward the drain sump. The channels are of increasing depth and slope toward the drain area and drain to facilitate the flow of water into the drain.

6 Claims, 5 Drawing Sheets

BASE FOR BARRIER-FREE SHOWER ENCLOSURE

TECHNICAL FIELD

This invention relates drain configurations generally, and more particularly, to a configuration for a base for a barrier-free shower enclosure which inhibits water from escaping through the barrier-free entrance to the shower enclosure.

BACKGROUND OF THE INVENTION

So-called barrier-free shower enclosures have, at their entrance, no raised portion or lip. The advantage and purpose of such a configuration is to enable a person in a wheelchair to enter or be easily wheeled into the enclosure. The disadvantage of a such a configuration is that no barrier exists to prevent water from running out over the base at the entrance and onto the floor adjoining the enclosure.

Traditional shower bases have a centrally located drain hole, usually with the base, on all surfaces, angled downwardly towards the drain. When there is a front barrier in the form of either a shower curtain, or a rigid sliding shower door, water exiting the shower head, or splashed within the enclosure, runs down the walls of the enclosure, and down the curtain or door. The water is thereby channeled toward the drain located in the base or floor of the enclosure. With a barrier-free configuration, this structure works on three of the four sides, but not on the fourth side, which is the entrance side of the barrier free enclosure.

SUMMARY OF THE INVENTION

The present invention is a base for a barrier-free shower enclosure having the combined configuration of a drain sump and drain, and a series of channels formed into the base of the shower enclosure which trap water within the shower enclosure and channel the water toward the drain sump. The channels are formed adjacent to opening, or entrance side, of the enclosure. Accordingly, it is an object of this invention to present a configuration of a drain sump, drain, and channels that inhibit the water from escaping the opening of a barrier-free shower enclosure.

DESCRIPTION OF THE PREFERRED EMBODIMENT

In the description of the following figures, like numbers refer to like features.

Figure 1:
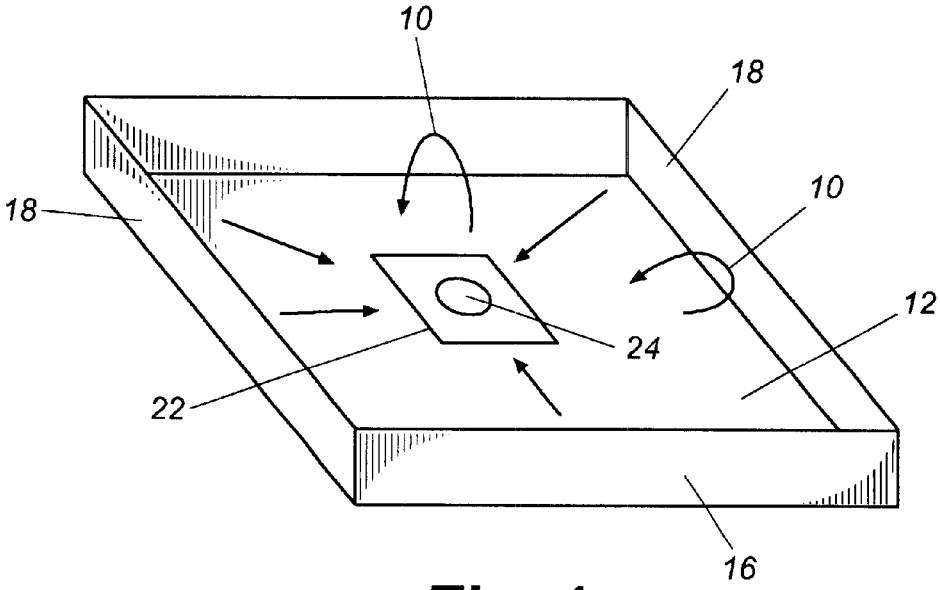
FIG. 1 demonstrates the water flow in a traditionally configured shower base.

As shown in FIG. 1, water, indicated by arrows 10, is reaching the base of a traditionally configured shower enclosure 12 having a front, partial lip or barrier 16. The water is deflected from the sides 18 and back 20 toward drain sump 22 and drain 24 which is centrally located within the shower base 26.

Figure 2:
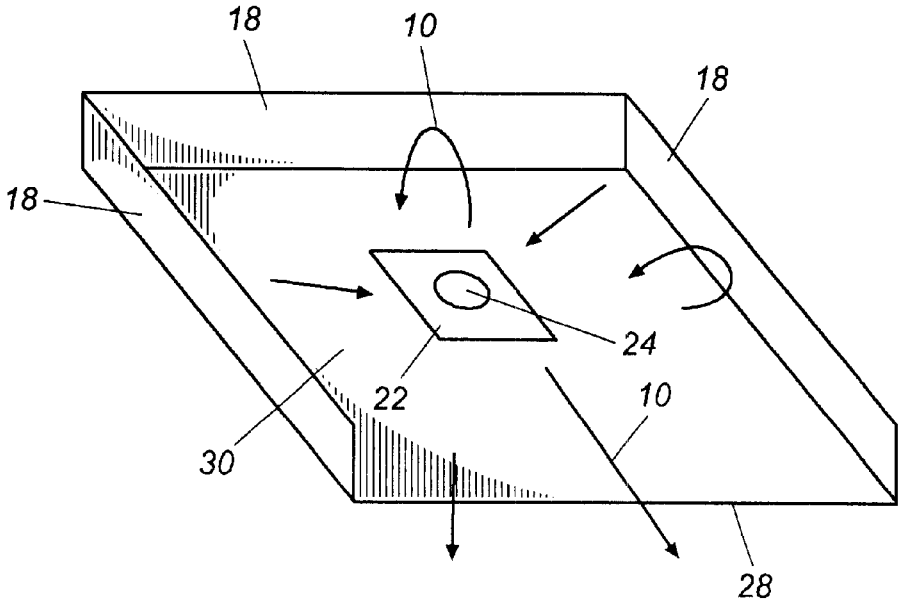
FIG. 2 shows the water flow in a traditionally configured shower base with a barrier-free entrance.

As shown in FIG. 2, when no front lip exists, water 10 spills outwardly onto the floor area adjoining front opening 28 of barrier-free shower base 30.

Figure 3:
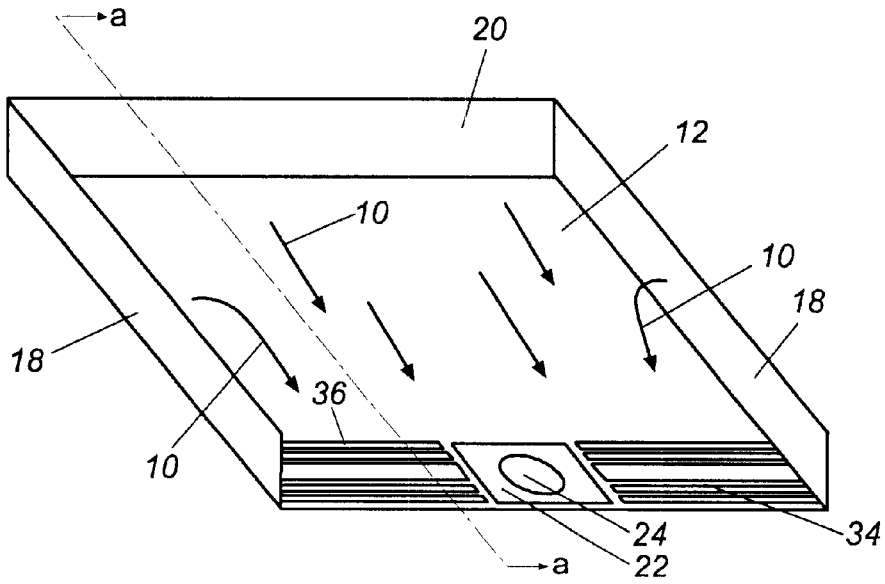
FIG. 3 shows the water flow in a barrier-free shower base with the configuration of the present invention.

FIG. 3 shows a first embodiment of a barrier-free shower base 30 having the configuration of the present invention. Drain 24 and drain sump 22 are positioned toward front opening 28 of barrier-free shower enclosure base 30. Barrier-free shower enclosure base 30 is preferably formed of a single sheet of fiberglass or acrylic material so that no joints or seams exist.

Figure 4:
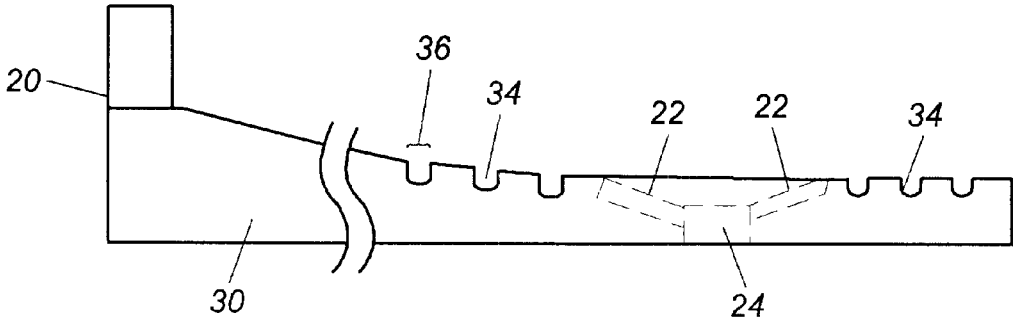
FIG. 4 shows a side view of the shower base of FIG. 3 taken along line a—a of FIG. 3.

FIG. 4 shows a side sectional view of barrier-free shower enclosure base 30 taken along line a—a of FIG. 3. This figure shows that floor 32 of barrier-free shower base is, on all sides, angled so that drain sump 22 and drain 24 are positioned lower than the sides of shower base 30 where those sides adjoin the walls of the shower enclosure. This angling, in addition to the channel and drain arrangement described above, serves to direct water toward drain sump 22 and drain 24.

Formed into barrier-free shower enclosure base 30 are channels 34, as shown in FIG. 4, the channels leading from the sides of the base and connecting with drain sump 22. Water exiting channels 34 is thus directed toward drain sump 22 and thence to drain 24. Channels 34 are so configured that they are shallower toward sides 18 of shower enclosure base 30 and deeper near drain sump 22 to aid in the flow of water toward drain 24. An example of this structure is demonstrated in FIGS. 6–10.

Top openings 36 to channels 34 should be sufficiently narrow to allow the wheels of a wheelchair to be easily moved across the top of the channels without entering the channels or getting stuck. The channels may have a cross-sectional dimension on a lower portion of the channels, near the bottom of the channels, which is greater than the spacing of the top opening. A greater, or increasing, cross-section on a lower portion of the channel will facilitate a larger volumetric flow of water, while providing a top opening which is both small enough to allow the wheelchair to traverse the device, and sufficiently large to allow water to enter the channels. As an alternative, a grate system could be used. A top grate allows water to access a single larger channel, or multiple channels positioned below the grate. The openings to the grate are sufficiently large to allow water to enter the channel which is below the top grate. In any configuration or alternative, the channel or channels, are of increasing depth and slope toward the drain area and drain to facilitate the flow of water into the drain.

Figure 5:
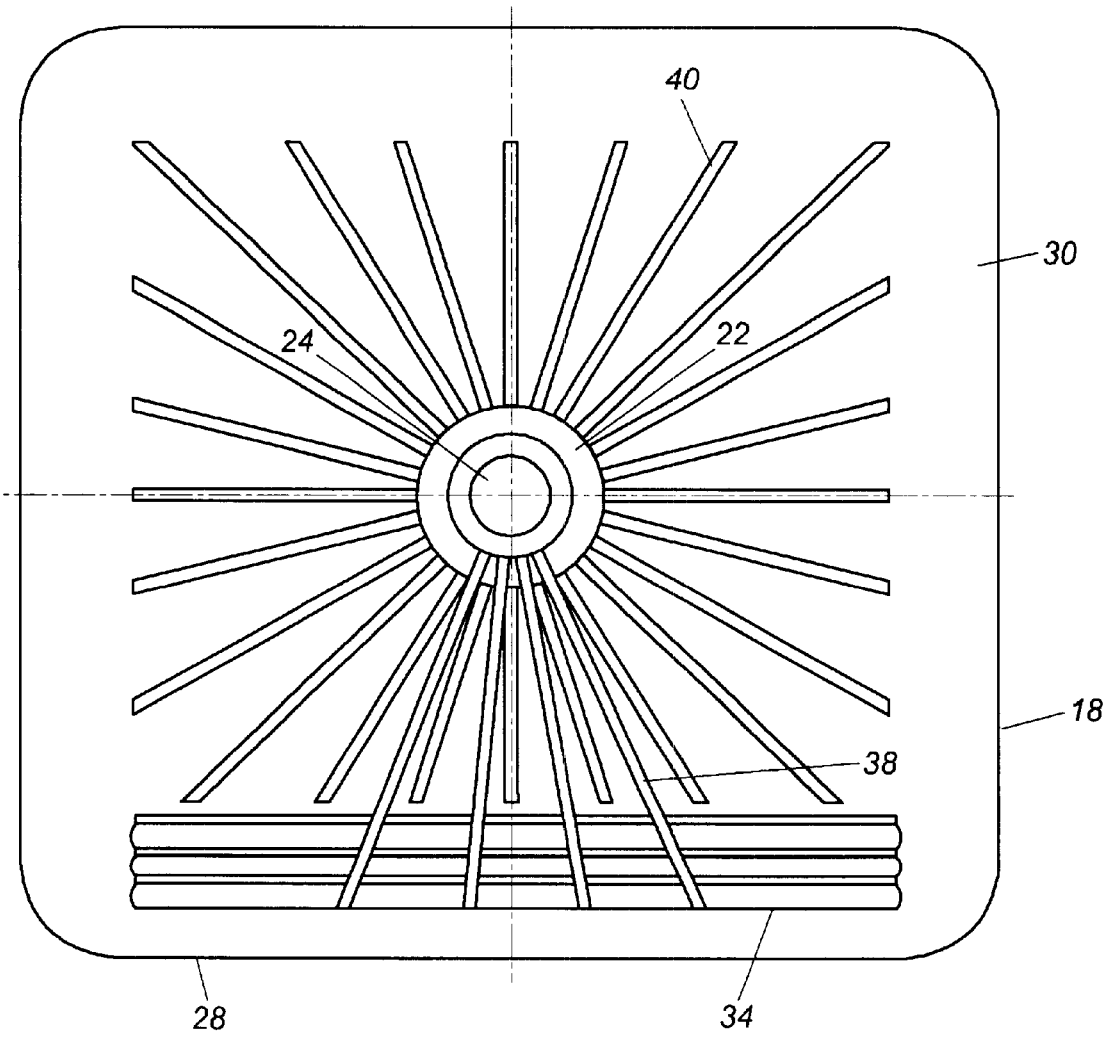
FIG. 5 shows another embodiment of the shower base of the present invention.
Figure 6:
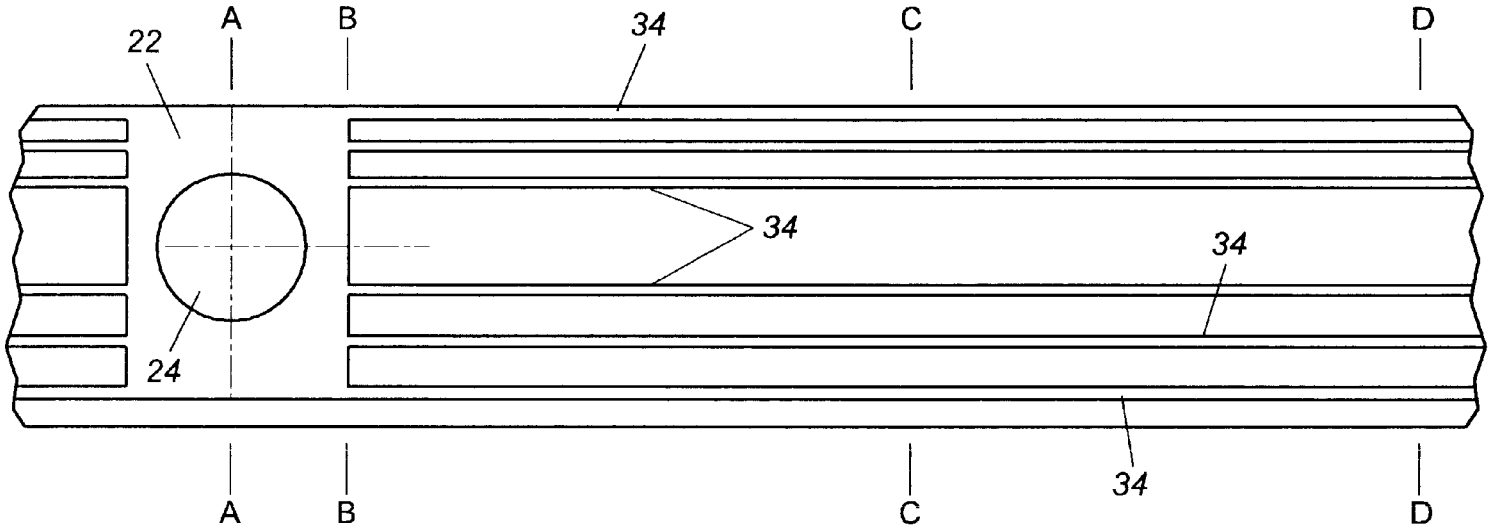
FIG. 6 is an enlarged top plan view of a portion of the base showing the channels, drain and the drain sump.
Figure 7:
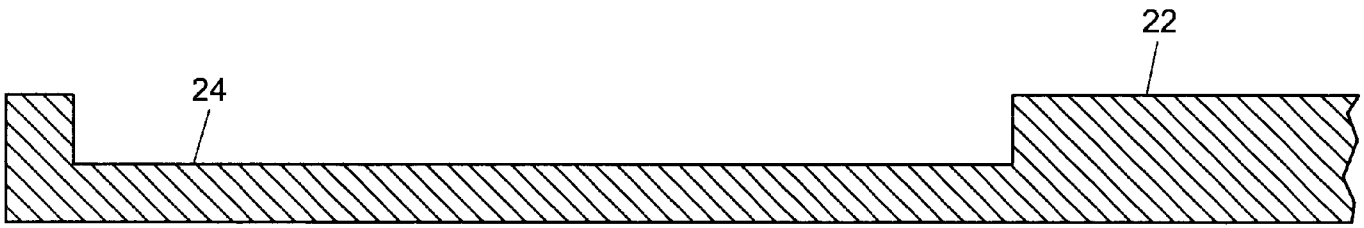
FIG. 7 is sectioned view taken essentially along line A—A of FIG. 6.
Figure 8:
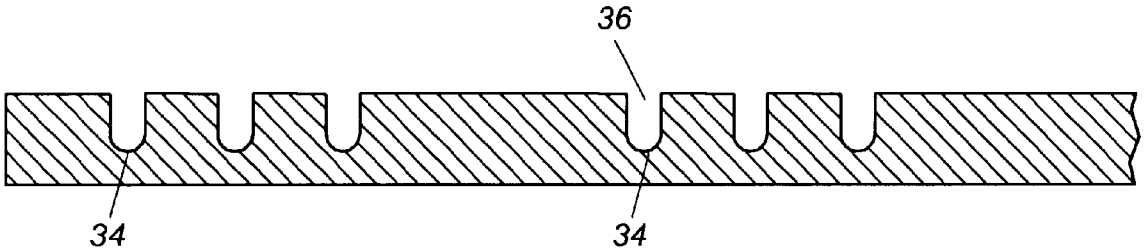
FIG. 8 is a sectioned view taken essentially along line B—B of FIG. 6.
Figure 9:
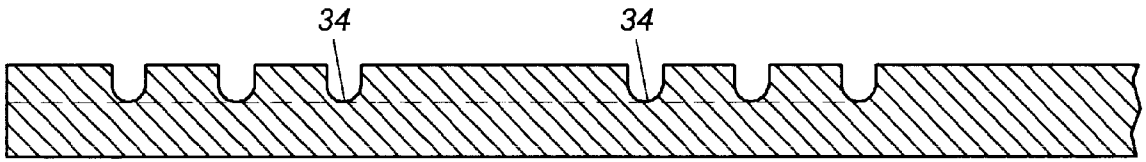
FIG. 9 is a sectioned view taken essentially along line C—C of FIG. 6.
Figure 10:
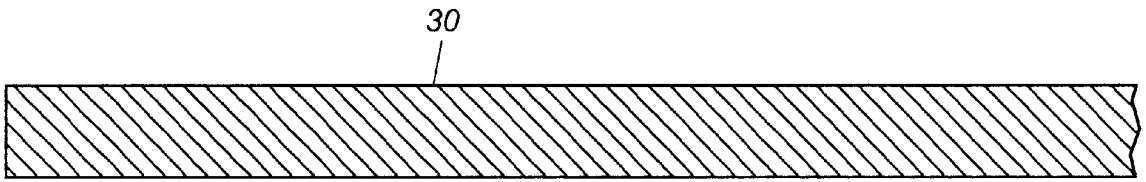
FIG. 10 is a sectioned view taken essentially along line D—D of FIG. 6.

As shown in FIG. 5, a differently configured arrangement of channels, drain sump and drain may be used. In this configuration, drain sump 22 and drain 24 are generally centrally located, as are most shower drains used in the prior art. Radial channels 38 connect with, and radiate outwardly from, drain sump 22 and drain 24. The sloping of the floor of base 30 is toward the drain. The radial channels slope from parallel channels 34 toward radial channels 38. The radial channels may increase in depth from the parallel channels to the drain.

As in the previous embodiment, the parallel channels 34 are positioned adjacent to the opening side of the barrier free shower. The structure of the channels is generally the same as the same as in the previous embodiment, except that the presence of a drain is optional, since the radial channels communicate with the parallel channels to transport water to the center drain as shown in FIG. 5. The parallel channels slope from the outer edge toward the radial channels, and perhaps to the center, if desired. The parallel channels may increase in depth from the outside to the inside, and have an increased cross section on a lower portion, as discussed above. Raised ribs 40 may be used to provide friction on the base, without interfering with the travel of the wheel chair.

Other channel structures could be used which do not depart from the spirit of the invention, which includes a channel structure near the opening of the barrier free shower which communicates with the drain, but does not interfere with the movement of a wheel chair into the shower enclosure.

In use, an occupant is positioned by means of a wheelchair within the shower. The wheelchair is rolled over the channels which essentially form the threshold at the entry side of the barrier-free shower. A shower curtain is placed in position over, but within the entry side. A device entitled "Continuously Weighted Shower Curtain," which is the subject of an application for U.S. Patent, and filed of even date herewith by the inventor, said application being incorporated herein by reference, could be used.

Other modifications of the base for barrier-free shower enclosure of the present invention will become apparent to those skilled in the art from an examination of the above patent specification and drawings. Therefore, other variations of the present invention may be made which fall within the scope of the following claims, even though such variations were not specifically discussed above.

What is claimed is:

1. A base for a shower enclosure having a barrier free threshold, comprising:

base member having a barrier free threshold formed therein and which extends along one side thereof, said base member having a plurality of channels which are formed in said base member and immediately adjacent to barrier free threshold, each of said plurality of channels formed generally parallel to a front side of said barrier free threshold; and a drain sump which is formed in said base member;

wherein said drain sump is formed adjacent to said barrier free threshold, and wherein a first plurality of channels is formed in said base member adjacent to said barrier free threshold and generally parallel to a front of said barrier free threshold, and said first plurality of channels is present on one side of said drain sump and each of said plurality of channels intersects said drain sump, and a second plurality of channels is formed adjacent to said barrier free threshold and generally parallel to a front of said barrier free threshold, and said second plurality of channels is present on an opposite side of said drain sump and each of said second plurality of channels intersects said drain sump.

2. A base for a shower enclosure having a barrier free threshold, comprising:

base member having a barrier free threshold formed therein and which extends along one side thereof, said base member having a plurality of channels which are formed in said base member and immediately adjacent to barrier free threshold, each of said plurality of channels formed generally parallel to a front side of said barrier free threshold; and a drain sump which is formed in said base member;

wherein said drain sump is formed in a location in said base member which is remote from said barrier free threshold, and wherein said base member has a second plurality of channels formed therein, wherein said second plurality of channels intersects said drain sump at one end of said second plurality of channels, and intersects said plurality of channels at an opposite end of said second plurality of channels.

3. A base for a shower enclosure having a barrier free threshold as described in claim 2, wherein said wherein said second plurality of channels each extends radially from and intersects said drain sump at one end of said second plurality of channels, and each of said second plurality of channels intersects said plurality of channels at an opposite end of said second plurality of channels.

4. A base for a shower enclosure having a barrier free threshold, comprising:

base member having a barrier free threshold formed therein and which extends along one side thereof, said base member having a plurality of channels which are formed in said base member immediately adjacent to said barrier free threshold, each of said plurality of channels formed generally parallel to another of said plurality of channels; and a drain sump which is formed in said base member;

wherein said drain sump is formed in said barrier free threshold, and wherein a first plurality of channels is formed in said base member and adjacent to said barrier free threshold, wherein each of said first plurality of channels is generally parallel to another of said first plurality of channels, and said first plurality of channels is present on one side of said drain sump and intersect said drain sump, and a second plurality of channels is formed in said base member and adjacent to said barrier free threshold, wherein each of said second plurality of channels is generally parallel to another of said second plurality of channels, and said second plurality of channels is present on an opposite side of said drain sump and intersect said drain sump, and wherein each of said first plurality of channels increases in depth along a length thereof from a first end thereof and toward said drain sump.

5. A base for a shower enclosure having a barrier free threshold, comprising:

base member having a barrier free threshold formed therein and which extends along one side thereof, said base member having a plurality of channels which are formed in said base member immediately adjacent to said barrier free threshold, each of said plurality of channels formed generally parallel to another of said plurality of channels; and a drain sump which is formed in said base member;

wherein said drain sump is formed in a location in said base member which is remote from said barrier free threshold, and wherein said base member has a second plurality of channels formed therein, wherein said second plurality of channels intersects said drain sump at one end of said second plurality of channels, and intersects said plurality of channels at an opposite end of said second plurality of channels.

6. A base for a shower enclosure having a barrier free threshold as described in claim 5, wherein said second plurality of channels extend radially from and intersect said drain sump at one end of said second plurality of channels, and intersects said plurality of channels at an opposite end of said second plurality of channels.

* * * * *